US005991924A

United States Patent [19]

Grilliot et al.

[11] Patent Number: 5,991,924

[45] Date of Patent: Nov. 30, 1999

[54] PROTECTIVE GARMENT WITH FOLDABLE CHINSTRAP

[75] Inventors: William L. Grilliot; Mary I. Grilliot, both of Dayton, Ohio

[73] Assignee: Norcross Safety Products, L.L.C., Oak Brook, Ill.

[21] Appl. No.: 08/985,608

[22] Filed: Dec. 5, 1997

[51] Int. Cl.[6] ..... A41D 13/00

[52] U.S. Cl. ..... 2/98; 2/81; 2/100

[58] Field of Search ..... 2/468, 60, 81, 2/85, 87, 91, 93, 96, 98, 100, 129, 135, 131, 141.1, 141.2

[56] References Cited

U.S. PATENT DOCUMENTS

| | | | |
|---|---|---|---|
| 3,231,899 | 2/1966 | Seidel et al. | 2/93 |
| 3,833,938 | 9/1974 | Shweid | 2/96 |
| 3,914,798 | 10/1975 | O'Keefe | 2/80 |
| 4,774,725 | 10/1988 | Page | 2/81 |
| 4,959,876 | 10/1990 | Kalaam et al. | 2/93 |
| 5,083,319 | 1/1992 | Grilliot et al. | 2/98 |
| 5,153,941 | 10/1992 | Grilliot et al. | 2/98 |
| 5,167,037 | 12/1992 | Grilliot | 2/98 |
| 5,189,737 | 3/1993 | Ribicic | 2/93 |
| 5,198,737 | 3/1993 | Ribicic | 2/93 |
| 5,297,295 | 3/1994 | Barbeau et al. | 2/96 |
| 5,406,648 | 4/1995 | Butzer et al. | 2/81 |
| 5,638,547 | 6/1997 | Hewitt | 2/81 |

*Primary Examiner*—Michael A. Neas
*Attorney, Agent, or Firm*—Rockey, Milnamow & Katz, Ltd.

[57] ABSTRACT

In a garment, such as a firefighter's garment, which has a collar having two front portions, a foldable chinstrap having a primary portion, a secondary portion, and two opposite ends may be fastened in a substantially permanent manner, as by sewing, at the primary portion to one such front portion of the collar, near one such end of the chinstrap. In an unfolded condition, in which the primary portion of the chinstrap is disposed below the secondary portion, the primary portion of the chinstrap can be releasably fastened, as by a hook-and-pile fastener, to the other front portion of the collar, near the other end of the chinstrap. In the unfolded condition, moreover, the secondary portion of the chinstrap can be releasably fastened, as by hook-and-pile fasteners, to the front portions of the collar, near the opposite ends of the chinstrap. In a folded condition, in which the secondary portion of the chinstrap is folded downwardly over the primary portion of the chinstrap, the secondary portion of the chinstrap can be releasably fastened, as by hook-and-pile fasteners, to the primary portion of the chinstrap, near the opposite ends of the chinstrap.

4 Claims, 2 Drawing Sheets

FIG. 4
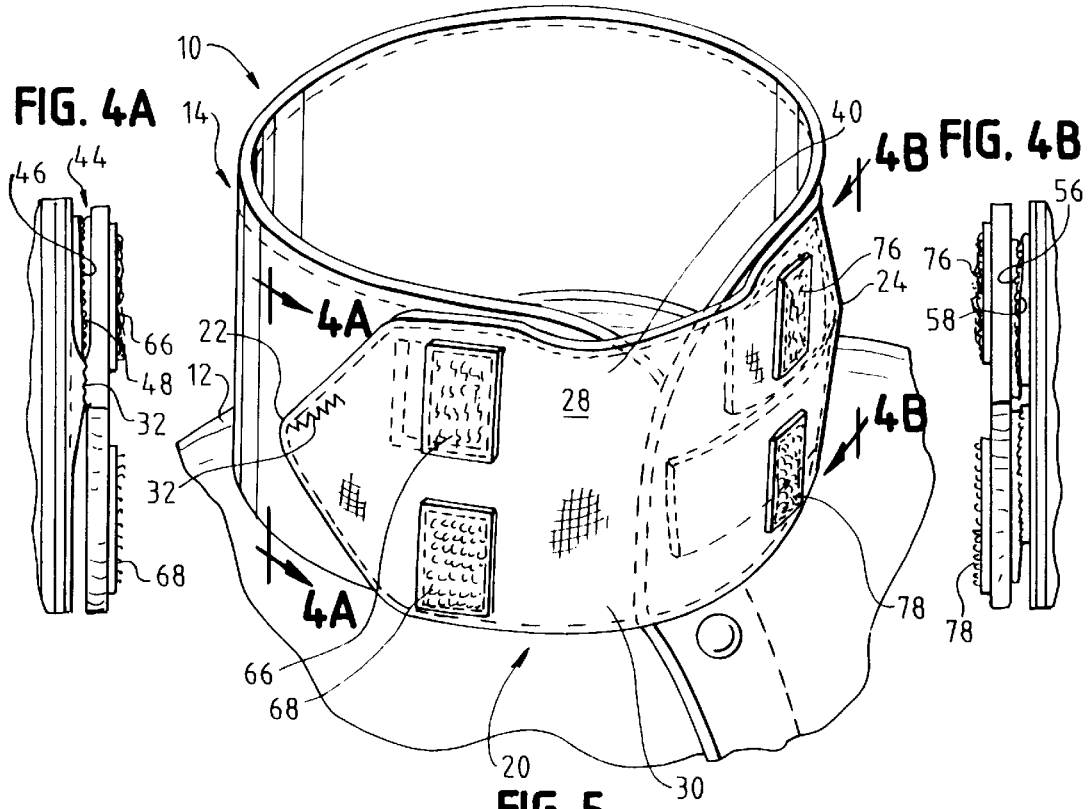
FIG. 4A
FIG. 4B
FIG. 5
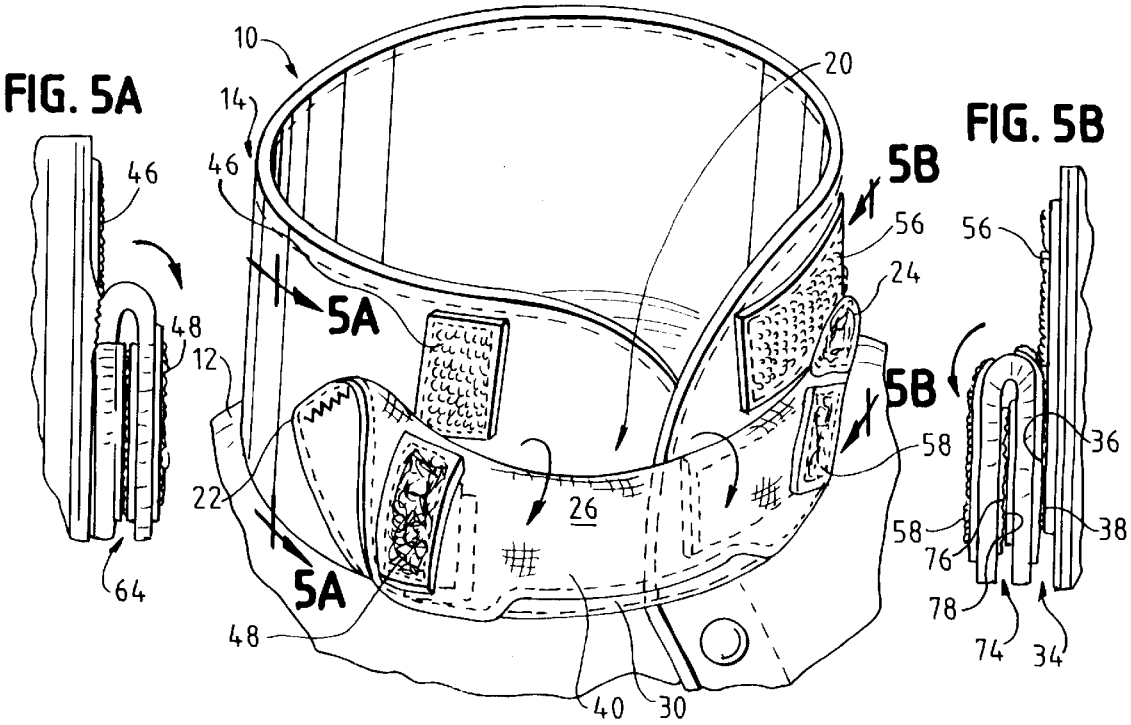
FIG. 5A
FIG. 5B

PROTECTIVE GARMENT WITH FOLDABLE CHINSTRAP

TECHNICAL FIELD OF THE INVENTION

This invention pertains to a protective garment, such as a firefighter's garment, which comprises a collar and a chinstrap. As improved by this invention, the protective garment has a chinstrap that is foldable between an unfolded condition and a folded condition, in which the chinstrap does not interfere with a breathing apparatus worn by a firefighter wearing the protective garment.

BACKGROUND OF THE INVENTION

Typically, a protective garment for a firefighter, such as a firefighter's coat, comprises a body, such as a coat, a collar sewn to the body, and a chinstrap, which spans two front portions of the collar when the protective garment is worn.

As exemplified in U.S. Pat. No. 3,833,938, the chinstrap is attached fixedly to one such front portion of the collar, possibly by sewing, and is fastened removably to the other front portion of the collar by a hook-and-pile fastener at one end of the chinstrap. As exemplified in U.S. Pat. No. 5,153,941 and in U.S. Pat. No. 5,167,037, the chinstrap is separate and is fastened removably to both front portions of the collar by hook-and-pile fasteners at both ends of the chinstrap.

A need has arisen, to which this invention is addressed, for a protective garment, as described, in which the chinstrap can be alternatively worn so as to cover more of the mouth and chin region of the wearer's face, as when a firefighter wearing the protective garment is involved in a tactical situation but is not wearing a breathing apparatus, or so as to cover less of the mouth and chin region of the wearer's face, as when a firefighter wearing the protective garment is involved in a tactical situation and is wearing a breathing apparatus or when such a firefighter is not involved in a tactical situation.

SUMMARY OF THE INVENTION

This invention provides improvements in a protective garment, such as a firefighter's garment, of a type comprising a collar having two front portions and a chinstrap having a primary portion, a secondary portion, and two opposite ends. As improved by this invention, the chinstrap is foldable between an unfolded condition, in which the primary portion is disposed below the secondary portion, and a folded condition.

The unfolded condition is suitable when a firefighter wearing the protective garment is involved in a tactical situation but is not wearing a breathing apparatus. The folded condition is suitable when a firefighter wearing the protective garment is involved in a tactical situation and is wearing a breathing apparatus or when such a firefighter is not involved in a tactical situation.

In either condition, the primary portion of the chinstrap is fastened to the front portions of the collar, near the opposite ends of the chinstrap. Preferably, in either condition, the primary portion of the chinstrap is fastened in a substantially permanent manner, as by sewing, to one such front portion of the collar, whereas the primary portion of the chinstrap is fastened releasably, as by a hook-and-pile fastener, to the other front portion of the collar, near the other end of the chinstrap.

In the unfolded condition, the secondary portion of the chinstrap is fastened releasably, as by hook-and-pile fasteners, to the front portions of the collar, near the opposite ends of the chinstrap. In the folded condition, in which the secondary portion of the chinstrap is folded downwardly over the primary portion of the chinstrap, the secondary portion of the chinstrap is fastened releasably, as by hook-and-pile fasteners, to the primary portion of the chinstrap, near the opposite ends of the chinstrap.

Rather than hook-and-pile fasteners, which are preferred, hook-and-eyelet fasteners, snap fasteners, buttons, or other releasable fasteners can be alternatively employed.

These and other objects, features, and advantages of this invention are evident from the following description of a preferred embodiment of this invention, with reference to the accompanying drawings.

BRIEF DESCRIPTION OF THE DRAWINGS

FIG. 4, on a similar scale, is a fragmentary, perspective view of the protective garment, as shown in FIG. 1.

FIGS. 4A and 4B are fragmentary details, as taken respectively along lines 4A—4A and 4B—4B in FIG. 4, in directions indicated by arrows.

FIG. 5, on a similar scale, is a fragmentary, perspective view of the protective garment, as shown in FIG. 2.

FIGS. 5A and 5B are fragmentary details, as taken respectively along lines 5A—5A and 5B—5B in FIG. 5, in directions indicated by arrows.

DETAILED DESCRIPTION OF THE PREFERRED EMBODIMENT

Figure 1:
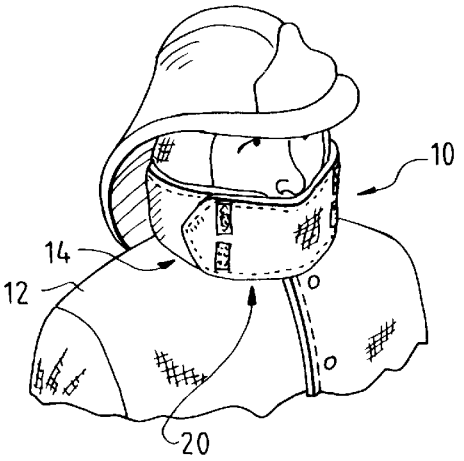
FIG. 1 is a fragmentary, perspective view of a firefighter wearing a protective garment embodying this invention, the protective garment comprising a collar and a chinstrap, which is shown as worn in an unfolded condition.

As shown in the drawings, a protective garment 10 for a firefighter constitutes a preferred embodiment of this invention. Broadly, the protective garment 10 comprises a body 12, such as a turnout coat for a firefighter or a dickey wearable with such a coat, a collar 14 sewn to the body 12 and having two front portions 16, 18, and a chinstrap 20, which is foldable between an unfolded condition and a folded condition. Desirably, the body, collar, and chinstrap of the protective garment 10 are made from materials specified in U.S. Pat. No. 5,083,319, the disclosure of which is incorporated by reference.

In the unfolded condition, as shown in FIG. 1, the chinstrap 20 covers more of the mouth and chin region of the wearer's face. The unfolded condition is suitable, therefore, when a firefighter wearing the protective garment 10 is involved in a tactical situation but is not wearing a breathing apparatus. With the chinstrap in its unfolded condition, the protective garment 10 passes the so-called "shower test" of the Emergency Medical Garment (EMS) standard of the National Fire Protection Association (NFPA) which test requires a wearer's torso to be perfectly dry after being subjected to a shower of surfactant water from all directions during a 20 minute exposure.

Figure 2:
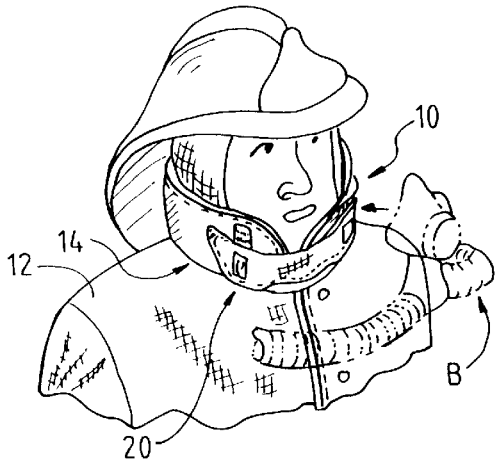
FIG. 2 is a fragmentary, perspective view similar to FIG. 1 but showing the chinstrap as worn in a folded condition, along with a breathing apparatus shown in dashed lines for illustrative purposes.

In the folded condition, as shown in FIG. 2, the chinstrap 20 covers less of the mouth and chin region of the wearer's face but does not interfere with a facemask F of a breathing apparatus B to be also worn by a firefighter wearing the protective garment 10. The folded condition is suitable, therefore, when a firefighter wearing the protective garment 10 is involved in a tactical situation and is wearing a breathing apparatus or when a firefighter wearing the protective garment 10 is not involved in a tactical situation.

Having two opposite ends 22, 24, and two expansive surfaces 26, 28, the chinstrap 20 has a primary portion 30, which is a lower portion in the unfolded condition of the chinstrap 20, and a secondary portion 40, which is an upper portion in the unfolded condition of the chinstrap 20. Near one such end 22, which is the left end in FIGS. 3, 4, and 5, the primary portion 30 of the chinstrap 20 may be fastened in a substantially permanent manner, by sewing 32, to an outwardly facing surface (unnumbered) of the collar portion 16. Near the other end 24, the primary portion 30 of the chinstrap 20 is fastened releasably to the collar portion 18, in either condition of the chinstrap 20, by a hook-and-pile fastener 34, which comprises a hook-faced panel 36 sewn or affixed adhesively or otherwise to an outwardly facing surface (unnumbered) of the collar portion 18 and a pile-faced panel 38 sewn or affixed adhesively or otherwise to the chinstrap surface 26, at the primary portion 30 of the chinstrap 20, near the chinstrap end 24.

In the unfolded condition, in which the primary portion 30 is disposed below the secondary portion 40, the secondary portion 40 of the chinstrap 20 is fastened releasably to the collar portion 16 by a hook-and-pile fastener 44, which comprises a hook-faced panel 46 sewn or affixed adhesively or otherwise to the outwardly facing surface of the collar portion 16 and a pile-faced panel 48 sewn or affixed adhesively or otherwise to the chinstrap surface 26, at the secondary portion 40 of the chinstrap 20, near the chinstrap end 24. In the unfolded condition, moreover, the secondary portion 40 of the chinstrap 20 is fastened releasably to the collar portion 16 by a hook-and-pile fastener 54, which comprises a hook-faced panel 56 sewn or affixed adhesively or otherwise to the outwardly facing surface of the collar portion 16 and a pile-faced panel 58 sewn or affixed adhesively or otherwise to the chinstrap surface 26, at the secondary portion 40 of the chinstrap 20, near the chinstrap end 26.

In the folded condition, in which the secondary portion 40 is folded outwardly and downwardly over the primary portion 30, the secondary portion is fastened releasably to the primary portion 30 by a hook-and-pile fastener 64 near the chinstrap end 22 and by a hook-and-pile fastener 74 near the chinstrap end 24. The hook-and-pile fastener 64 comprises a hook-faced panel 66 sewn or affixed adhesively or otherwise to the chinstrap surface 28, at the secondary portion 30, near the chinstrap end 22 and a pile-faced panel 68 sewn or affixed adhesively or otherwise to the chinstrap surface 28, at the primary portion 30 of the chinstrap 20, near the chinstrap end 22. The hook-and-pile fastener 74 comprises a hook-faced panel 76 sewn or affixed adhesively or otherwise to the chinstrap surface 28, at the secondary portion 30, near the chinstrap end 24 and a pile-faced panel 78 sewn or affixed adhesively or otherwise to the chinstrap surface 28, at the primary portion 30 of the chinstrap 20, near the chinstrap end 24.

Figure 3:
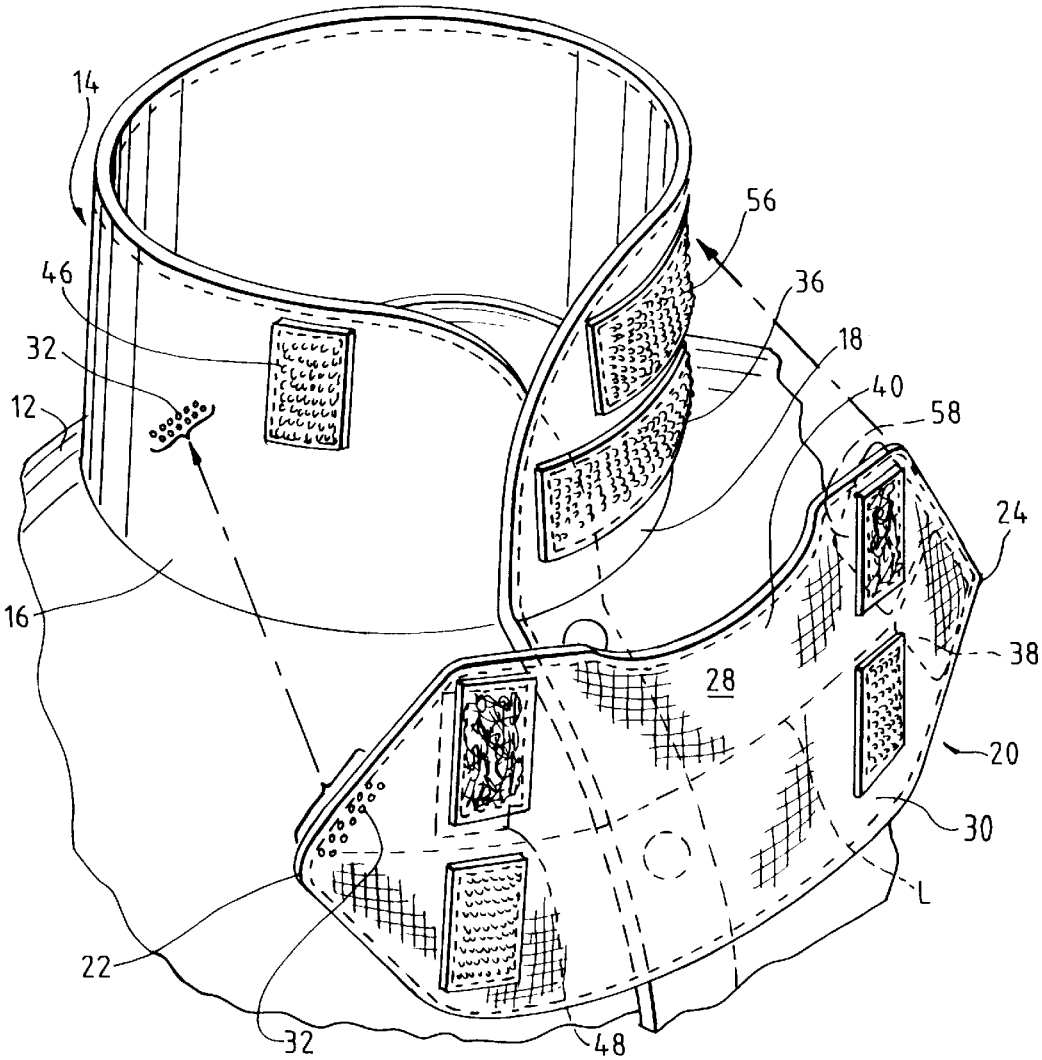
FIG. 3, on a larger scale, is a partly exploded, perspective view of the protective garment with the chinstrap pulled away for illustrative purposes.

As shown in FIG. 3, the hook-and-pile fastener panels 58, 68, 78, affixed to the primary portion 30 of the chinstrap 20 are spaced from the hook-and-pile fastener panels 56, 66, 76, affixed to the secondary portion 40 of the chinstrap 20, on opposite sides of an imaginary folding line L extending between the chinstrap ends 22, 24, and the hook-and-file fastener panel 38 affixed to the primary portion 30 of the chinstrap 20 is affixed to one side of the imaginary folding line L, so as to facilitate folding and unfolding of the chinstrap 20 along the imaginary folding line L, between the unfolded and folded conditions. It is not necessary, therefore, to fold or unfold any of the hook-and-pile fastener panels.

Although the hook-and-pile fasteners 44, 54, 64, 74, are preferred as allowing the chinstrap 20 to be adjustably positioned when fastened releasably in either condition, it is contemplated to replace one or more of the hook-and-pile fasteners 44, 54, 64, 74, with one or more releasable fasteners (not shown) of other known types, such as hook-and-eyelet fasteners, snap fasteners, or buttons.

Other modifications may be also made without departing from the scope and spirit of this invention.

We claim:

1. A garment comprising a collar having two front portions, a chinstrap being foldable and having a primary portion, a secondary portion, and two opposite ends, means for fastening the primary portion of the chinstrap to one said front portion of the collar, near one said end of the chinstrap, means for fastening the primary portion of the chinstrap releasably to the other front portion of the collar, near the other end of the chinstrap, means for fastening the secondary portion of the chinstrap releasably to the front portions of the collar, near the opposite ends of the chinstrap, in an unfolded condition, in which the primary portion of the chinstrap is disposed below the secondary portion of the chinstrap, and means for fastening the secondary portion of the chinstrap releasably to the primary portion of the chinstrap, near the opposite ends of the chinstrap, in a folded condition, in which the secondary portion of the chinstrap is folded downwardly over the primary portion of the chinstrap.

2. The garment of claim 1 wherein each means for fastening releasably comprises at least one hook-and-pile fastener comprising a hook-faced panel and a pile-faced panel.

3. The garment of claim 2 wherein the hook-faced and pile-faced panels of the hook-and-pile fasteners include panels affixed to the primary portion of the chinstrap and panels affixed to the secondary portion of the chinstrap and wherein the panels affixed to the primary portion of the chinstrap are spaced from the panels affixed to the secondary portion of the chinstrap, on opposite sides of an imaginary folding line extending between the chinstrap ends, so as to facilitate folding and unfolding of the chinstrap along the imaginary folding line, between the unfolded and folded conditions.

4. The garment of claim 1, 2, or 3 wherein the means for fastening the primary portion of the chinstrap to one said front portion of the collar is adapted for fastening in a substantially permanent manner.

* * * * *